US007631787B1

(12) United States Patent
Lee

(10) Patent No.: US 7,631,787 B1
(45) Date of Patent: Dec. 15, 2009

(54) POWDER METERING TUBE FOR POWDER MEASURING DEVICE

(76) Inventor: Richard J. Lee, 3146 Kettle Moraine Rd., Hartford, WI (US) 53207

( * ) Notice: Subject to any disclaimer, the term of this patent is extended or adjusted under 35 U.S.C. 154(b) by 0 days.

(21) Appl. No.: 12/272,134

(22) Filed: Nov. 17, 2008

(51) Int. Cl.
*B65D 88/54* (2006.01)
*F42B 33/02* (2006.01)

(52) U.S. Cl. ..... 222/288; 222/306; 222/308; 86/31

(58) Field of Classification Search ..... 222/282, 222/288, 289, 292, 306, 307, 308, 390; 86/31, 86/29

See application file for complete search history.

(56) References Cited

U.S. PATENT DOCUMENTS 1,027,216 A * 5/1912 Sapp ..... 604/224
1,252,719 A * 1/1918 Proctor ..... 401/174
2,550,827 A 5/1951 Lachmiller
2,778,528 A * 1/1957 Corcoran ..... 222/46
3,090,524 A * 5/1963 Corcoran ..... 222/46
3,145,883 A * 8/1964 Geroux ..... 222/306
3,386,329 A * 6/1968 Rohrbacher ..... 86/31
4,151,933 A 5/1979 Myers
4,253,490 A * 3/1981 Hansel ..... 137/590
4,418,606 A * 12/1983 Lee ..... 86/31
4,560,352 A * 12/1985 Neumeister et al. ..... 433/90
5,079,986 A * 1/1992 Lee ..... 86/39
6,176,396 B1 * 1/2001 Hamada et al. ..... 222/137
7,150,379 B2 * 12/2006 Lee ..... 222/390

* cited by examiner

*Primary Examiner*—Kevin P Shaver
*Assistant Examiner*—Daniel R Shearer
(74) *Attorney, Agent, or Firm*—Donald J. Ersler

(57) ABSTRACT

A powder meter tube includes a metering tube and a metering assembly. The metering assembly is retained in the metering tube. The metering tube includes a nut cutout and a graduated slot. The metering assembly includes a threaded shaft, a micrometer nut, a piston and a bearing. A threaded hole is formed through the micrometer nut to threadably receive the threaded shaft. The bearing includes a base and two spring fingers that extend from the base. The piston is pressed on to one end of the threaded shaft and the bearing pressed on to an opposite end of the threaded shaft. The spring fingers allow the metering assembly to be inserted into the metering tube and the micrometer nut to protrude through the nut cutout. In use, the micrometer nut is rotated in either direction to increase or decrease the powder capacity in the metering tube.

20 Claims, 2 Drawing Sheets

POWDER METERING TUBE FOR POWDER MEASURING DEVICE

BACKGROUND OF THE INVENTION

1. Field of the Invention

The present invention relates generally to powder measuring devices and more specifically to a powder metering tube for a powder measuring device, which is faster and easier to adjust than that of the prior art.

2. Discussion of the Prior Art

U.S. Pat. No. 2,550,827 to Lachmiller discloses a rotary trap chamber with means for varying the volume thereof. The Lachmiller patent includes a powder measuring device, which enables accurately metered quantities of powder or the like to be measured. The powder measuring device includes means for accurately adjusting the volume of material to be measured. U.S. Pat. No. 4,151,933 to Myers discloses a powder measure device. The Meyers patent includes a drum having two apertures and a metering piston assembly wherein the metering piston includes means for changing the diameter of the operative end of the metering piston. U.S. Pat. Nos. 2,550,827 and 4,151,933 are herein incorporated by reference to illustrate the operation of a powder measure device.

Accordingly, there is a clearly felt need in the art for a powder metering tube for a powder measuring device, which is faster and easier to adjust for small charges used in handgun ammunition, and quickly adjusted for large rifle cartridges.

SUMMARY OF THE INVENTION

The present invention provides a powder metering tube for a powder measuring device, which is quickly and accurately adjustable through a full volume range in a fraction of the time required by currently available adjustable powder measures. The powder meter tube includes a metering tube and a metering assembly. The metering assembly is retained in the metering tube. The metering tube includes a nut cutout and a graduated slot.

The metering assembly preferably includes a threaded shaft, a micrometer nut, an o-ring, a piston and a bearing. The micrometer nut includes a graduated scale and a knurled surface formed on an outer perimeter thereof. A threaded hole is formed through the micrometer nut to threadably receive the threaded shaft.

The bearing includes a base and two spring fingers that extend from the base. Substantially all of a perimeter of the bearing is sized to be slidably received by an inner perimeter of the metering tube. The piston is pressed on to one end of the threaded shaft and the bearing is pressed on to an opposite end of the threaded shaft. The spring fingers allow the metering assembly to be inserted into the metering tube and the micrometer nut with an o-ring retained in a counter bore to protrude through the nut cutout. The threaded shaft is offset from a centerline of the metering tube. In use, a full length of a finger is rubbed against the micrometer nut to rotate thereof in either direction to increase or decrease the powder capacity in the metering tube. The powder meter tube is inserted into a powder measuring device.

Accordingly, it is an object of the present invention to provide a powder metering tube, which is intuitive to use, and is easier and faster to adjust than that of the prior art, yet includes the same accuracy as the prior art devices.

It is a further object of the present invention to provide a powder metering tube with a threaded shaft, which is not exposed during use to protect it from dust and damage.

Finally, it is another object of the present invention to provide a powder metering tube with an o-ring that eliminates the need for an adjustment knob to be locked in place with a lock nut.

These and additional objects, advantages, features and benefits of the present invention will become apparent from the following specification.

DETAILED DESCRIPTION OF THE PREFERRED EMBODIMENTS

Figure 1:
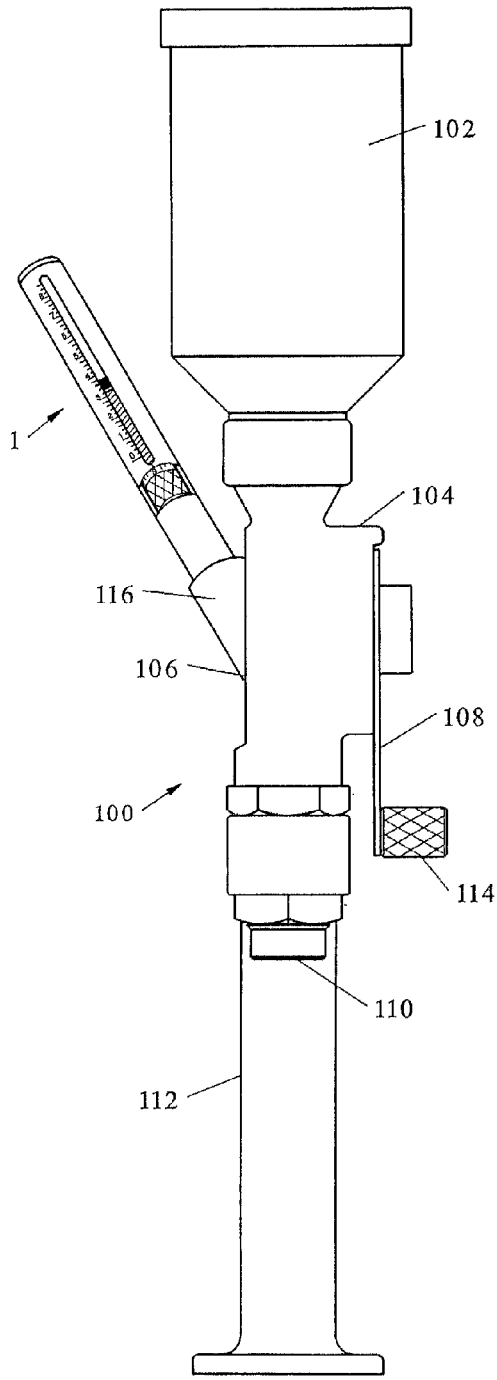
FIG. 1 is a front view of a powder metering tube inserted in a powder measuring device in accordance with the present invention.

With reference now to the drawings, and particularly to FIG. 1, there is shown a front view of a powder measuring tube 1 inserted into a powder measuring device 100. The powder measuring device 100 includes a powder hopper 102, a drum housing 104, a drum 106, a crank 108, a drop tube 110 and a stand 112. The drum 106 is pivotally retained in the drum housing 104. One end of the crank 108 is attached to an end of the drum 106 and a crank knob 114 is attached to the other one end of the crank 108. The powder hopper 102 is attached to a top of the drum housing 104. The stand 112 is attached to a bottom of the drum housing 104 and supports the powder measuring device 100. A tube boss 116 extends from a side of the drum 106. The tube boss 116 includes a bore into which the powder measuring tube 1 is inserted.

In use, powder is poured into the powder hopper 102. Powder is dispensed into the powder measuring tube 1, when the drum 106 is rotated 120 degrees (from the position shown in FIG. 1) by the crank 108. The drum 106 is rotated back 120 degrees to allow the powder in the powder measuring tube 1 to fall through the drop tube 110 into a cartridge case (not shown), which is held against the drop tube 110. Further operating information concerning the powder measuring device 100 may be found in U.S. Pat. Nos. 2,550,827 and 4,151,933.

Figure 2:
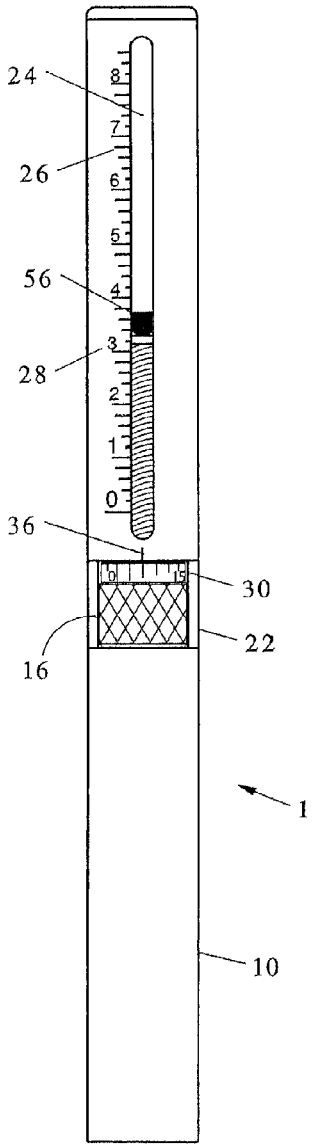
FIG. 2 is a front view of a powder metering tube in accordance with the present invention.
Figure 3:
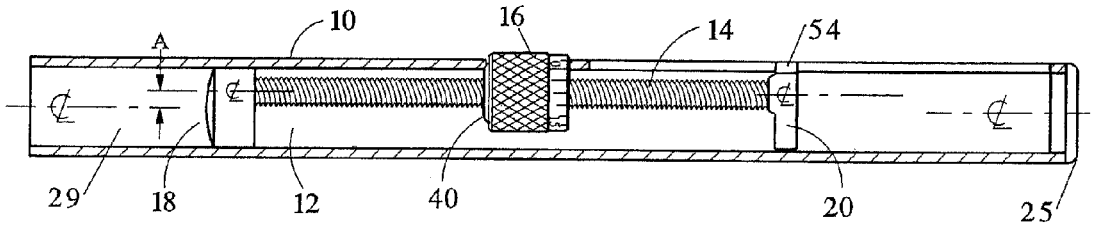
FIG. 3 is a cross sectional view of a powder metering tube in accordance with the present invention.
Figure 4:
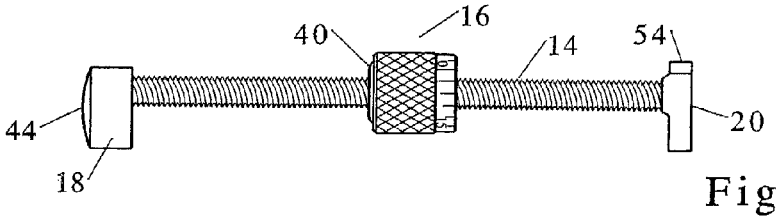
FIG. 4 is a front view of a powder assembly of a powder metering tube in accordance with the present invention.

With reference to FIGS. 2-4, the powder measuring tube 1 includes a metering tube 10 and a metering assembly 12. The metering assembly 12 is retained in the metering tube 10. The metering assembly 12 includes a threaded shaft 14, a micrometer nut (adjustment nut) 16, a piston 18 and a bearing 20. A nut cutout 22 is formed through substantially a middle of the metering tube 10 to allow a portion of the micrometer nut 16 to protrude through the metering tube 10. A graduated slot 24 is formed between the nut cutout 22 and one end of the metering tube 10. Graduation lines 26 and numbers 28 are printed adjacent at least one side of the graduated slot 24 to illustrate the volume of powder contained in the powder chamber 29 at the other end of the metering tube 10. A cap 25 is preferably secured in the one end of the metering tube 10 to prevent disassembly or tampering with the powder measuring tube 1.

Figure 5:
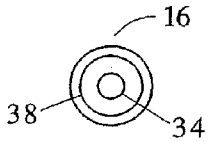
FIG. 5 is an end view of a micrometer nut of a powder metering tube in accordance with the present invention.
Figure 6:
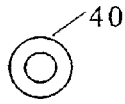
FIG. 6 is an end view of an o-ring of a powder metering tube in accordance with the present invention.
Figure 7:
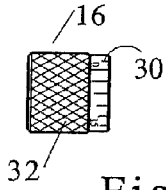
FIG. 7 is a front view of a micrometer nut of a powder metering tube in accordance with the present invention.

With reference to FIGS. 5-7, the micrometer nut 16 includes a graduated scale 30 located adjacent a knurled surface 32 on an outer perimeter thereof. The graduated scale 30 includes graduation lines and numbers. A graduation line 36 is formed in the metering tube 10, adjacent the graduated scale 30 of the micrometer nut 16. A threaded hole 34 is formed through the micrometer nut 16 to threadably receive the threaded shaft 14. An o-ring counterbore 38 is formed in one end of the micrometer nut 16 to receive an o-ring 40.

The o-ring 40 preferably extends from an end of the micrometer nut 16. The o-ring 40 preferably contacts the threaded shaft 14 and an inside perimeter of the metering tube 10 to inhibit the micrometer nut 16 from pivoting and changing a volume measurement in the powder chamber 29. The o-ring 40 inhibits rotation of the micrometer nut 16 without requiring a lock nut, while not providing enough friction to resist rotation by a finger stroke along a length of the finger. However, other devices may also be used to inhibit rotation of the micrometer nut 16, such as a resilient insert retained in the meter tube 10 that contacts the micrometer nut 16.

Figure 8:
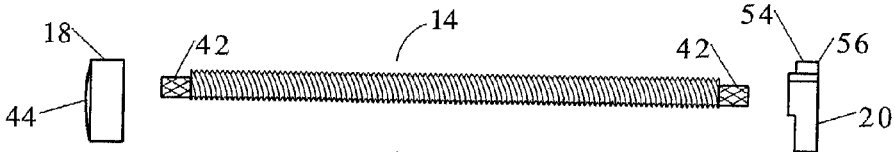
FIG. 8 is a front view of a metering assembly with a micrometer nut, a piston and a bearing removed from a threaded shaft of a powder metering tube in accordance with the present invention.
Figure 9:
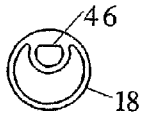
FIG. 9 is an end view of a piston of a powder metering tube in accordance with the present invention.
Figure 10:
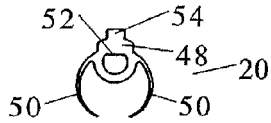
FIG. 10 is an end view of a bearing of a powder metering tube in accordance with the present invention.

With reference to FIGS. 8-10, a D-shaped end 42 is preferably formed on each end of the threaded shaft 14. A rounded portion of the D-shaped end 42 is preferably knurled. A convex surface 44 is preferably formed on one end of the piston 18 and a D-shaped cavity 46 is formed in the other end of the piston 18 to receive the D-shaped end 42 of the threaded shaft 14. A press-fit is preferably created between the D-shaped cavity 46 and the D-shaped end 42.

The bearing 20 includes a base 48 and two spring fingers 50 that extend from a bottom of the base 48. Substantially all of a perimeter of the bearing 20 is sized to be slidably received by an inner perimeter of the metering tube 10. A D-shaped bore 52 is formed through the bearing 20. A press-fit is preferably created between the D-shaped bore 52 and the D-shaped end 42. An indicator projection 54 extends upward from a top of the base 48. A width of the indicator projection 54 is sized to be received by a width of the graduated slot 24. An edge 56 of the indicator projection 54 indicates a volume of powder that will be retained in the powder chamber 29. The indicator projection 54 prevents rotation of the threaded shaft 14. However, other methods of preventing rotation may also be used, such as making the piston 18 non-rotating.

The piston 18 is pressed on to one end of the threaded shaft 14 and the bearing 20 is pressed on to an opposite end of the threaded shaft 14. Ends of the spring fingers 50 are pushed toward the base 48 to allow the metering assembly 12 to be inserted into the metering tube 10. After the micrometer nut 16 protrudes through the nut cutout 22, the spring fingers 50 will spring back to their normal orientation. The threaded shaft 14 is preferably offset from a centerline of the metering tube 10 by a dimension "A." Dimension "A" does not have a preferred value. The micrometer nut 16 is rotated in either direction to increase or decrease the powder capacity in the powder chamber 29. The graduated scale 30 on the micrometer nut 16 relative to the graduation line 36 allows fine adjustment of the powder chamber 29 powder capacity.

In use, a full length of a finger is rubbed against the micrometer nut 16 to rotate thereof in either direction to increase or decrease the powder capacity in the metering tube. Friction within prior art metering tubes will not allow a finger to be rubbed across the prior art adjustment knob. The prior art adjustment knob must be rotated with two fingers and a turn of the wrist, which makes applicant's invention faster and easier than the prior art. The o-ring 40 eliminates the need for the adjustment knob to be locked with a lock nut. The o-ring 40 inhibits the micrometer nut 16 from rotating.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A powder metering tube in combination with a powder measuring device comprising:

a metering tube having a nut cutout;

an adjustment nut being sized to be received by said nut cutout;

a threaded shaft having one end that is sized to be received by an inner perimeter of said metering tube, said threaded shaft being threaded into said adjustment nut;

a piston being retained on said one end of said threaded shaft, a powder chamber being created in said metering tube between an end of said metering tube and an end of said piston, a volume of said powder chamber being changed by said adjustment nut, said powder chamber being filled by the powder measuring device; and means for preventing the rotation of said threaded shaft.

2. The powder metering tube in combination with a powder measuring device of claim 1, further comprising:

a graduated slot being formed through said metering tube adjacent said nut cutout, a plurality of graduation lines and numbers being printed adjacent at least one side of said graduated slot to illustrate the volume of powder contained in the other end of said metering tube.

3. The powder metering tube in combination with a powder measuring device of claim 2, further comprising:

said means for preventing rotation being an indicator projection, said indicator projection extending from the other end of said threaded shaft, said indicator projection being sized to be slidably received by said graduated slot.

4. The powder metering tube in combination with a powder measuring device of claim 3, further comprising:

a bearing having a base, two spring fingers and said indicator projection, said indicator projection extending from a top of said base, said two spring fingers extending from a bottom of said base.

5. The powder metering tube in combination with a powder measuring device of claim 1, further comprising:

an o-ring being retained in an end of said adjustment nut, said o-ring contacting at least one of said threaded shaft and said inner perimeter of said metering tube.

6. The powder metering tube in combination with a powder measuring device of claim 1, further comprising:

said adjustment nut including a graduated scale on an outside perimeter thereof.

7. The powder metering tube in combination with a powder measuring device of claim 1, further comprising:

a centerline of said threaded shaft being offset from a centerline of said metering tube.

8. The powder metering tube in combination with a powder measuring device of claim 1, further comprising:

said piston having a convex surface formed on one end thereof.

9. A powder metering tube in combination with a powder measuring device comprising:

a metering tube having a nut cutout;

an adjustment nut being sized to be received by said nut cutout, means for inhibiting the rotation of said adjustment nut;

a threaded shaft having one end that is sized to be received by an inner perimeter of said metering tube, said threaded shaft being threaded into said adjustment nut, the other end of said threaded shaft being supported in said metering tube;

a piston being retained on said one end of said threaded shaft, a powder chamber being created in said metering tube between an end of said metering tube and an end of said piston, a volume of said powder chamber being changed by said adjustment nut, said powder chamber being filled by the powder measuring device; and means for preventing the rotation of said threaded shaft.

10. The powder metering tube in combination with a powder measuring device of claim 9, further comprising:

a graduated slot being formed through said metering tube adjacent said nut cutout, a plurality of graduation lines and numbers being printed adjacent at least one side of said graduated slot to illustrate the volume of powder contained in the other end of said metering tube.

11. The powder metering tube in combination with a powder measuring device of claim 10, further comprising:

said means for preventing rotation being an indicator projection, said indicator projection extending from the other end of said threaded shaft, said indicator projection being sized to be slidably received by said graduated slot.

12. The powder metering tube in combination with a powder measuring device of claim 11, further comprising:

a bearing having a base, two spring fingers and said indicator projection, said indicator projection extending from a top of said base, said two spring fingers extending from a bottom of said base.

13. The powder metering tube in combination with a powder measuring device of claim 9, further comprising:

said means for inhibiting the rotation of said adjustment nut being an o-ring, said o-ring being retained in an end of said adjustment nut, said o-ring contacting at least one of said threaded shaft and said inner perimeter of said metering tube.

14. The powder metering tube in combination with a powder measuring device of claim 9, further comprising:

a centerline of said threaded shaft being offset from a centerline of said metering tube.

15. The powder metering tube in combination with a powder measuring device of claim 9, further comprising:

said piston having a convex surface formed on one end thereof.

16. A powder metering tube in combination with a powder measuring device comprising:

a metering tube having a nut cutout and a graduated slot;

an adjustment nut being sized to be received by said nut cutout;

a threaded shaft having one end that is sized to be received by an inner perimeter of said metering tube, said threaded shaft being threaded into said adjustment nut, the other end of said threaded shaft being supported in said metering tube;

a piston being retained on said one end of said threaded shaft, a powder chamber being created in said metering tube between an end of said metering tube and an end of said piston, a volume of said powder chamber being changed by said adjustment nut, said Powder chamber being filled by the powder measuring device; and an indicator projection extending from the other end of said threaded shaft, said indicator projection being sized to be slidably received by said graduated slot.

17. The powder metering tube in combination with a powder measuring device of claim 16, further comprising:

a plurality of graduation lines and numbers being printed adjacent at least one side of said graduated slot to illustrate the volume of powder contained in the other end of said metering tube.

18. The powder metering tube in combination with a powder measuring device of claim 16, further comprising:

a bearing having a base, two spring fingers and said indicator projection, said indicator projection extending from a top of said base, said two spring fingers extending from a bottom of said base.

19. The powder metering tube in combination with a powder measuring device of claim 16, further comprising:

an o-ring being retained in an end of said adjustment nut, said o-ring contacting at least one of said threaded shaft and said inner perimeter of said metering tube.

20. The powder metering tube in combination with a powder measuring device of claim 16, further comprising:

a centerline of said threaded shaft being offset from a centerline of said metering tube.

* * * * *